US011011302B2

(12) United States Patent
Hirai et al.

(10) Patent No.: US 11,011,302 B2
(45) Date of Patent: May 18, 2021

(54) COMMON-MODE CHOKE COIL

(71) Applicant: Murata Manufacturing Co., Ltd., Kyoto (JP)

(72) Inventors: Shinya Hirai, Nagaokakyo (JP); Yuki Kanbe, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/831,140

(22) Filed: Dec. 4, 2017

(65) Prior Publication Data

US 2018/0090265 A1 Mar. 29, 2018

Related U.S. Application Data

(62) Division of application No. 14/207,328, filed on Mar. 12, 2014, now Pat. No. 9,870,857.

(30) Foreign Application Priority Data

Apr. 15, 2013 (JP) ..... 2013-084878

(51) Int. Cl.
*H01F 27/34* (2006.01)
*H01F 17/04* (2006.01)
*H01F 17/00* (2006.01)

(52) U.S. Cl.
CPC ..... *H01F 27/34* (2013.01); *H01F 17/045* (2013.01); *H01F 2017/0093* (2013.01)

(58) Field of Classification Search
CPC ..... H01F 27/34; H01F 27/28; H01F 27/2823; H01F 2027/2838; H01F 2027/2742; H01F 17/045; H01F 17/04; H01F 17/00; H01F 2017/0093
USPC ..... 336/188, 192, 189, 190, 187
See application file for complete search history.

(56) References Cited

U.S. PATENT DOCUMENTS 2,865,086 A * 12/1958 Whipple ..... H01F 41/08 29/605
3,114,120 A * 12/1963 Heck ..... H03H 7/42 333/25
4,763,072 A * 8/1988 Katoh ..... G01C 17/28 324/253
4,771,957 A * 9/1988 Schlake ..... H01F 41/08 242/437.1

(Continued)

FOREIGN PATENT DOCUMENTS

DE 10 2008 053 412 A1 5/2010
JP 2003-109836 A 4/2003

(Continued)

OTHER PUBLICATIONS

An Office Action; "Notification of Reasons for Rejection," issued by the Japanese Patent Office dated Mar. 24, 2015, which corresponds to Japanese Patent Application No. 2013-084878 and is related to U.S. Appl. No. 14/207,328; with English language translation.

(Continued)

*Primary Examiner* — Mang Tin Bik Lian
(74) *Attorney, Agent, or Firm* — Studebaker & Brackett PC

(57) ABSTRACT

A common-mode choke coil having; a core that extends in a predetermined direction; and first and second wires that are intertwined and wound together around the core.

10 Claims, 6 Drawing Sheets

(56) References Cited

U.S. PATENT DOCUMENTS 4,782,582 A * 11/1988 Venezia ..... H01F 41/02 29/605
5,075,663 A * 12/1991 Lim ..... H01F 17/062 336/229
5,726,611 A * 3/1998 Takagi ..... H01F 17/06 333/181
6,150,896 A * 11/2000 DeCramer ..... H03H 7/42 333/25
6,472,969 B1 10/2002 Hanato
6,522,230 B2 2/2003 Hanato et al.
6,938,327 B2 9/2005 Takayama et al.
7,573,363 B2 * 8/2009 Yamashita ..... H01F 19/08 323/356
8,686,822 B2 4/2014 Huang et al.
9,590,486 B2 * 3/2017 MacLennan ..... H01F 27/2823
9,633,774 B2 * 4/2017 Xu ..... H01F 17/062
2003/0006874 A1 * 1/2003 Chou ..... H01F 3/14 336/229
2003/0071704 A1 * 4/2003 Toi ..... H01F 27/365 336/83
2006/0033603 A1 2/2006 Hirai et al.
2008/0143470 A1 * 6/2008 Suzuki ..... H01F 27/2895 336/233
2008/0224813 A1 9/2008 Hirai et al.
2009/0045902 A1 * 2/2009 Hirai ..... H01F 17/045 336/192
2009/0195342 A1 * 8/2009 Azuma ..... H01F 17/045 336/192
2009/0219127 A1 * 9/2009 Tomonari ..... H01F 19/04 336/192
2010/0045418 A1 * 2/2010 Nishikawa ..... H01F 17/045 336/192
2010/0090790 A1 * 4/2010 Azuma ..... H01F 17/04 336/192
2010/0148912 A1 6/2010 Nakatani et al.

FOREIGN PATENT DOCUMENTS

JP 2004-260095 A 9/2004
JP 2005-056934 A 3/2005
JP 2006-339250 A * 12/2006

OTHER PUBLICATIONS

An Office Action; "Decision of Final Rejection," issued by the Japanese Patent Office dated Jun. 30, 2015, which corresponds to Japanese Patent Application No. 2013-084878 and is related to U.S. Appl. No. 14/207,328; with English language translation.

* cited by examiner

COMPARATIVE EXAMPLE

COMPARATIVE EXAMPLE

COMMON-MODE CHOKE COIL

CROSS REFERENCE TO RELATED APPLICATIONS

This application is a Divisional of U.S. application Ser. No. 14/207,328 filed on Mar. 12, 2014, and claims benefit of priority to Japanese Patent Application No. 2013-084878 filed on Apr. 15, 2013, the content of which is incorporated herein by reference.

TECHNICAL FIELD

The present invention relates to common-mode choke coils, including, for example, a wire-wound common-mode choke coil.

BACKGROUND

As an invention related to a conventional common-mode choke coil, a common-mode noise filter described in, for example, Japanese Patent Laid-Open Publication No. 2005-56934 is known. The common-mode filter has a first wire wound around a drum core and a second wire wound over the first wire.

However, the common-mode choke coil described in Japanese Patent Laid-Open Publication No. 2005-56934 might not be able to effectively remove common-mode noise. FIG. 4 provides graphs showing the relationship between positions along the first wire and potential and the relationship between positions along the second wire and potential.

Since the common-mode choke coil has the second wire wound over the first wire, the second wire is longer than the first wire. In this case, when differential-mode signals are transmitted through the first and second wires, the potential at one end of the first wire and the potential at one end of the second wire are equal in absolute value, as shown in FIG. 4, but the potential at the other end of the first wire and the potential at the other end of the second wire are not necessarily equal in absolute value. As a result, the differential-mode signals are outputted as common-mode noise.

SUMMARY

A common-mode choke coil according to an embodiment of the present invention includes a core configured to extend in a predetermined direction, and first and second wires configured to be intertwined and to be wound together around the core.

DETAILED DESCRIPTION

Hereinafter, a common-mode choke coil according to an embodiment of the present invention will be described.

Configuration of Common-Mode Choke Coil

Figure 1A:
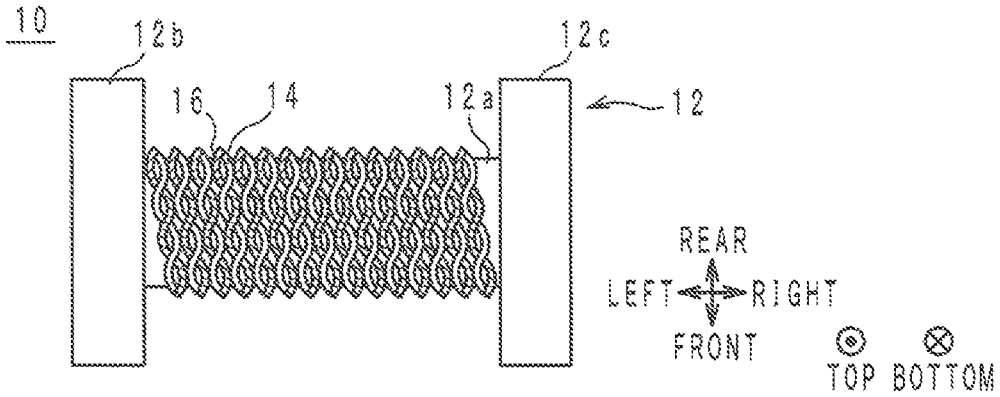
FIG. 1A is a top view of a common-mode choke coil according to an embodiment.
Figure 1B:
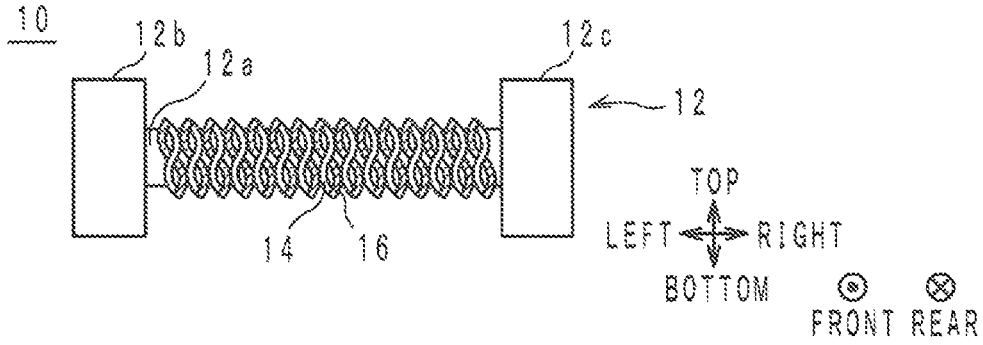
FIG. 1B is a front view of the common-mode choke coil according to the embodiment.
Figure 1C:
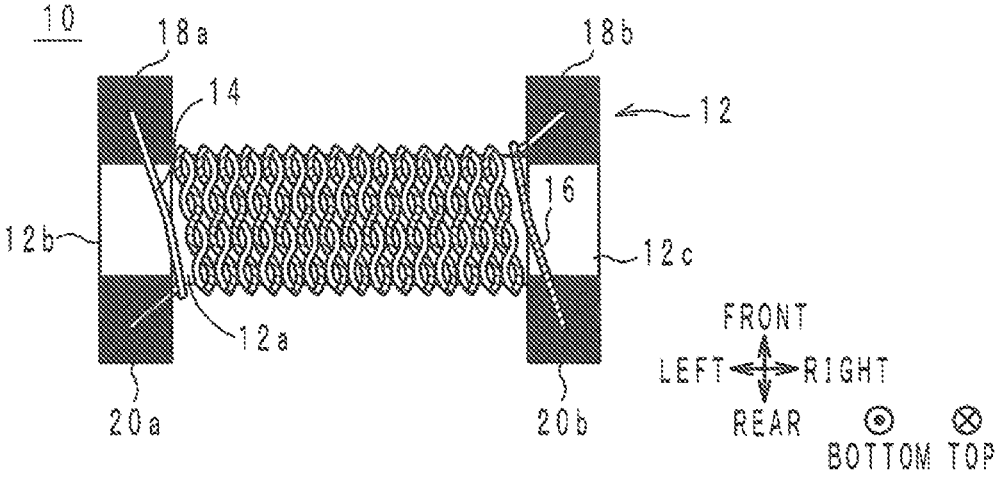
FIG. 1C is a bottom view of the common-mode choke coil according to the embodiment.

The configuration of the common-mode choke coil 10 according to the embodiment will be described below with reference to the drawings. FIG. 1A is a top view of the common-mode choke coil 10 according to the embodiment. FIG. 1B is a front view of the common-mode choke coil 10 according to the embodiment. FIG. 1C is a bottom view of the common-mode choke coil 10 according to the embodiment. In the following, the longitudinal direction of the common-mode choke coil 10 will be defined as the right-left direction, and directions perpendicular to the right-left direction will be defined as the top-bottom direction and the front-rear directions.

The common-mode choke coil 10 includes a core 12, wires 14 and 16, and external electrodes 18*a*, 18*b*, 20*a*, and 20*b*, as shown in FIGS. 1A, 1B, and 1C.

The core 12 is made of a magnetic material (e.g., NiCuZn ferrite), and is in the form of an H when viewed in a top view, a bottom view, a front view, and also a rear view. The core 12 includes a core member 12*a* and flanges 12*b* and 12*c*, as shown in FIGS. 1A, 1B, and 1C.

The core member 12*a* is in the form of a quadrangular prism extending in the right-left direction. However, the core member 12*a* may be in another form such as a column.

The flange 12*b* is in the form of a rectangular solid, and is connected to the left end of the core member 12*a*. The flange 12*b*, when viewed in a left-side view, juts out from the core member 12*a* both in the top-bottom direction and the front-rear direction.

The flange 12*c* is in the form of a rectangular solid, and is connected to the right end of the core member 12*a*. The flange 12*c*, when viewed in a right-side view, juts out from the core member 12*a* both in the top-bottom direction and the front-rear direction.

The external electrode 18*a* is provided in the form of a rectangle and positioned on the front side at the bottom of the flange 12*b* relative to the center in the front-rear direction. The external electrode 18*a* is formed by an electrode base made of Ag being plated with Ni and Sn.

The external electrode 18*b* is provided in the form of a rectangle and positioned on the front side at the bottom of the flange 12*c* relative to the center in the front-rear direction. The external electrode 18*b* is formed by an electrode base made of Ag being plated with Ni and Sn.

The external electrode 20*a* is provided in the form of a rectangle and positioned on the rear side at the bottom of the flange 12*b* relative to the center in the front-rear direction. The external electrode 20*a* is formed by an electrode base made of Ag being plated with Ni and Sn.

The external electrode 20*b* is provided in the form of a rectangle and positioned on the rear side at the bottom of the flange 12*c* relative to the center in the front-rear direction. The external electrode 20*b* is formed by an electrode base made of Ag being plated with Ni and Sn.

The wires 14 and 16 are intertwined and wound together around the core member 12*a* of the core 12. Moreover, the wires 14 and 16 are helically wound in the same direction.

Furthermore, both ends of the wire 14 are led out from the core member 12*a*. The left end of the wire 14 is connected to the external electrode 18*a*. The right end of the wire 14 is connected to the external electrode 18*b*.

Furthermore, both ends of the wire 16 are led out from the core member 12*a*. The left end of the wire 16 is connected to the external electrode 20*a*. The right end of the wire 16 is connected to the external electrode 20*b*.

In the common-mode choke coil 10 thus configured, the wires 14 and 16 overlap with each other when viewed in a right-side view. Accordingly, magnetic flux produced by the wire 14 passes through a space surrounded by the wire 16, and magnetic flux produced by the wire 16 passes through a space surrounded by the wire 14. Therefore, the wires 14 and 16 are magnetically coupled to each other, so that the common-mode choke coil is created by the wires 14 and 16. Moreover, for example, the external electrodes 18*a* and 20*a* are used as input terminals, and the external electrodes 18*b* and, 20*b* are used as output terminals. That is, differential-mode signals are inputted to the external electrodes 18*a* and 20*a*, and outputted from the external electrodes 18*b* and 20*b*. In the case where the differential-mode signals contain common-mode noise, the common-mode noise causes the wires 14 and 16 to produce magnetic flux in the same direction. Therefore, the magnetic flux is intensified, resulting in impedance against common-mode components, so that common-mode noise is prevented from passing through the wires 14 and 16.

Method for Producing Coil Components

Next, the method for producing the common-mode choke coil 10 will be described with reference to the drawings.

First, powder mainly composed of ferrite from which to make a core 12 is prepared. Then, the prepared ferrite powder is provided in a female die. The provided powder is compacted by a male die, thereby shaping a core member 12*a* and flanges 12*b* and 12*c*. Further, the core 12 is sintered. As a result, the core 12 is completed.

Next, external electrodes 18*a*, 18*b*, 20*a*, and 20*b* are formed on the bottoms of the flanges 12*b* and 12*c* of the core 12. More specifically, the bottoms of the flanges 12*b* and 12*c* are immersed in a container filled with an Ag paste so as to cause the Ag paste to adhere to the bottoms. Then, the adhered Ag paste is dried and sintered, thereby forming electrode bases on the bottoms of the flanges 12*b* and 12*c*. Further, Ni alloy-based metal films and Sn alloy-based metal films are formed on the electrode bases by electroplating or suchlike. As a result, the external electrodes 18*a*, 18*b*, 20*a*, and 20*b* are formed.

Next, wires 14 and 16 are wound around the core member 12*a* of the core 12. More specifically, the wires 14 and 16 are intertwined into one. Thereafter, the intertwined wires 14 and 16 are wound around the core member 12*a*. At this time, both ends of each of the wires 14 and 16 are led out from the core member 12*a* by a predetermined length.

Lastly, the led-out portions of the wires 14 and 16 are connected to the external electrodes 18*a*, 18*b*, 20*a*, and 20*b* by thermocompression bonding. Through the above process, the common-mode choke coil 10 is completed.

Effects

Figure 2:
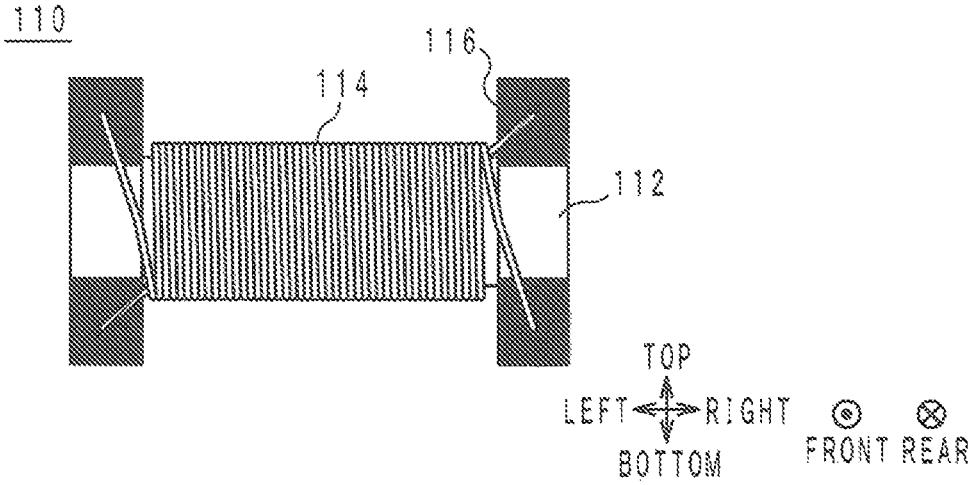
FIG. 2 is a bottom view of a common-mode choke coil according to a comparative example.
Figure 3:
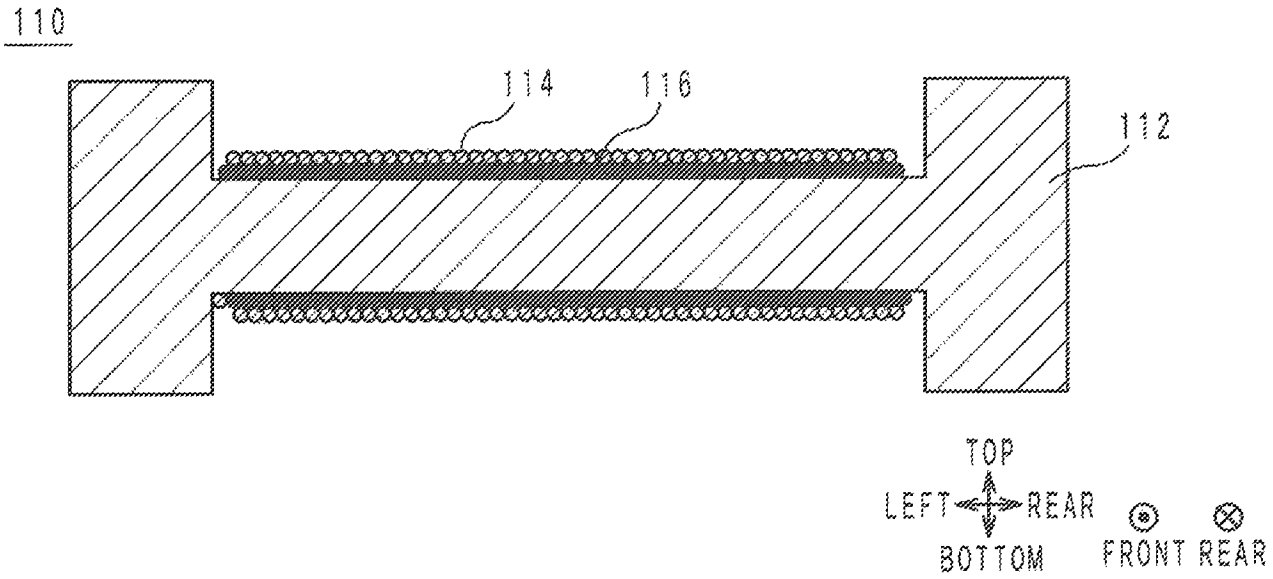
FIG. 3 is a cross-sectional structure view of the common-mode choke coil according to the comparative example.
Figure 4:
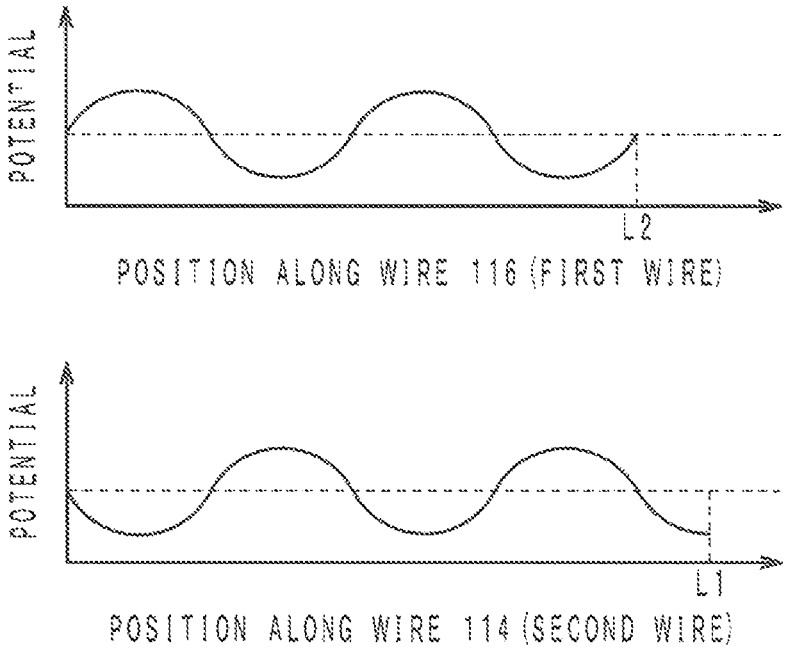
FIG. 4 provides graphs showing the potentials of wires upon input of differential mode signals to the common-mode choke coil.

The common-mode choke coil 10 thus configured renders it possible to effectively remove common-mode noise. FIG. 2 is a bottom view of a common-mode choke coil 110 according to a comparative example. FIG. 3 is a cross-sectional structure view of the common-mode choke coil 110 according to the comparative example. FIG. 4 provides graphs showing the potentials of wires 114 and 116 upon input of differential-mode signals to the common-mode choke coil 110.

The common-mode choke coil 110 includes a core 112 and the wires 114 and 116. The wire 116 is wound around the core 112, and the wire 114 is wound over the wire 116.

In the common-mode choke coil 110 according to the comparative example, the length L1 of the wire 114 is longer than the length L2 of the wire 116. In this case, when differential-mode signals are transmitted through the wires 114 and 116, the potential at the left end of the wire 114 and the potential at the left end of the wire 116 are equal in absolute value, as shown in FIG. 4, but the potential at the right end of the wire 114 and the potential at the right end of the wire 116 are not necessarily equal in absolute value. As a result, the differential-mode signals are outputted as common-mode noise.

On the other hand, in the case of the common-mode choke coil 10, the wires 14 and 16 are intertwined and wound together around the core member 12*a* of the core 12. Accordingly, the wires 14 and 16 are approximately equal in winding radius. As a result, the wires 14 and 16 are also approximately equal in length. Therefore, when differential-mode signals are transmitted through the wires 14 and 16, the potential at the left end of the wire 14 and the potential at the left end of the wire 16 are equal in absolute value at each time point, and the potential at the right end of the wire 14 and the potential at the right end of the wire 16 are also equal in absolute value at each time point. Consequently, the differential-mode signals are inhibited from being outputted as common-mode noise. Thus, the common-mode choke coil 10 renders it possible to effectively remove common-mode noise.

To better clarify the effects achieved by the common-mode choke coil, the present inventors carried out experimentation as described below. Initially, a common-mode choke coil 110 as shown in FIGS. 2 and 3 was made as a first sample, and a common-mode choke coil 10 as shown in FIGS. 1A, 1B, and 1C was made as a second sample. Note that the details of the first and second samples are as follows:

Size: 4.5 mm×3.2 mm×2.6 mm

Number of turns: 46

Wire diameter: 0.04 mm

Figure 5:
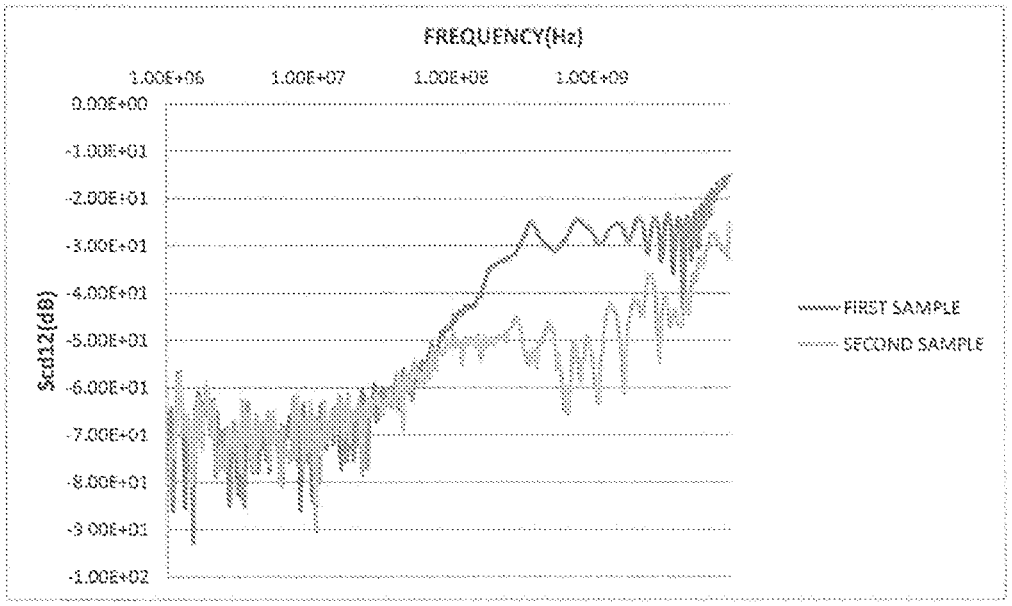
FIG. 5 is a graph showing the relationship between frequency and Scd12.
Figure 6:
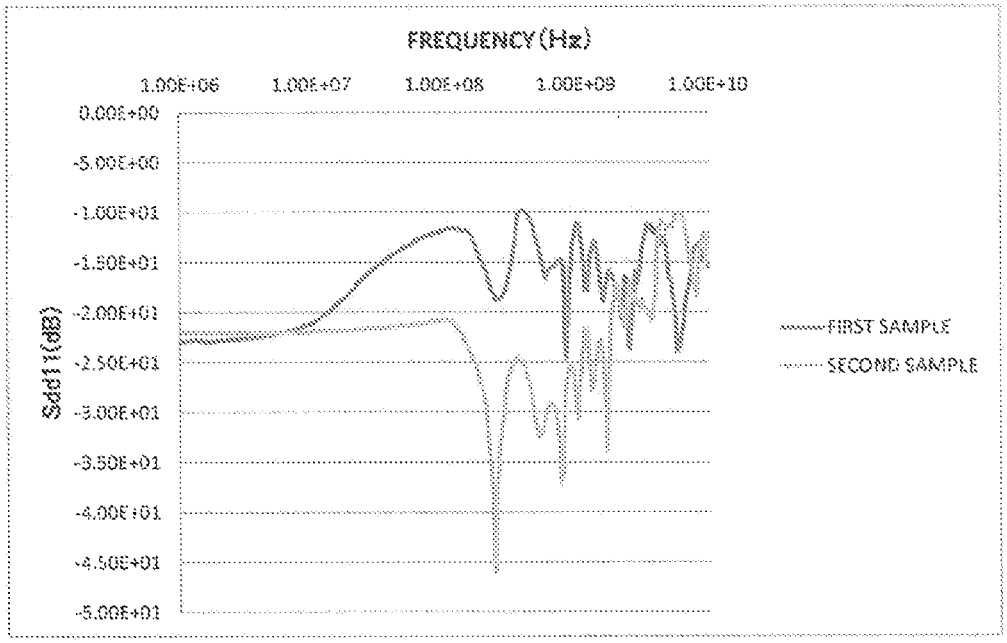
FIG. 6 is a graph showing the relationship between frequency and Sdd11.

S-parameters of the first and second samples as above were measured. More specifically, Scd12 and Sdd11 were calculated for each of the first and second samples. Scd12 is a parameter that indicates the value of the intensity ratio of a common-mode signal outputted from the external electrode 18*a* to a differential-mode signal inputted to the external electrode 18*b*. That is, Scd12 indicates the proportion of the differential-mode signal converted into the common-mode signal. Sdd11 is a parameter that indicates the value of the intensity ratio of a differential-mode signal outputted from the external electrode 18*a* to a differential-mode signal inputted to the external electrode 18*a*. That is, Sdd11 indicates the amount of reflection of the differential-mode signal. FIG. 5 is a graph showing the relationship between frequency and Scd12. The vertical axis represents Scd12, and the horizontal axis represents the frequency. FIG. 6 is a graph showing the relationship between frequency and Sdd11. The vertical axis represents Sdd11, and the horizontal axis represents the frequency.

It can be appreciated that the value of Scd12 was smaller for the second sample than for the first sample, as shown in FIG. 5. Accordingly, it can be appreciated that the proportion of the differential-mode signal converted into the common-mode signal was lower for the second sample than for the first sample. That is, it can be appreciated that common-mode noise was removed more effectively in the common-mode choke coil 10 than in the common-mode choke coil 110.

Furthermore, it can be appreciated that the value of Sdd11 was smaller for the second sample than for the first sample, as shown in FIG. 6. Accordingly, it can be appreciated that the amount of reflection of the differential-mode signal was lower for the second sample than for the first sample. The reason for this will be described below. As the value of Scd12 decreases for the above reason, the value of Sdc12 decreases as well for the same reason. Here, Sdc12 is a parameter that indicates the value of the intensity ratio of a differential-mode signal outputted from the external electrode 18*a* to a common-mode signal inputted to the external electrode 18*b*. More specifically, the value of the intensity ratio of a differential-mode signal outputted from the external electrode 18*a* to a common-mode signal inputted to the external electrode 18*b* decreases. As a result, the intensity of the differential-mode signal outputted from the external electrode 18*a* decreases. Therefore, the value of the intensity ratio of the differential-mode signal outputted from the external electrode 18*a* to the differential-mode signal inputted to the external electrode 18*b* (i.e., Sdd11) decreases as well. Thus, the amount of reflection of the differential-mode signal is lower for the second sample than for the first sample.

Other Embodiments

The present invention is not limited to the common-mode choke coil 10, and variations can be made within the spirit and scope of the invention.

Although the present invention has been described in connection with the preferred embodiment above, it is to be noted that various changes and modifications are possible to those who are skilled in the art. Such changes and modifications are to be understood as being within the scope of the invention.

What is claimed is:

1. A common-mode choke coil comprising:

a core configured to extend in a predetermined direction; and first and second wires intertwined and wound together around the core, wherein:

the first wire of the intertwined and wound first and second wires makes contact with the second wire of an adjacent segment of the intertwined and wound first and second wires at at least three points which are evenly spaced in the common-mode choke coil, the core includes a first end side and a second end side opposite the first end side in the predetermined direction, and a first terminal end and a second terminal end of the first wire are on the first end side and the second end side of the core respectively with respect to the predetermined direction, and a first terminal end and a second terminal end of the second wire are on the first end side and the second end side of the core respectively with respect to the predetermined direction.

2. The common-mode choke coil according to claim 1, further comprising:

first and second external electrodes connected to the respective first terminal end and the second terminal end of the first wire, and third and fourth external electrodes connected to the respective first terminal end and the second terminal end of the second wire.

3. The common-mode choke coil according to claim 1, wherein the first terminal end and the second terminal end of the first wire and the first terminal end and the second terminal end of the second wire are not grounded.

4. The common-mode choke coil according to claim 1, wherein apart from the first wire and the second wire, the common-mode choke coil does not include a wire wound around the core.

5. The common-mode choke coil according to claim 1, wherein a differential-mode signal is to be inputted to each of the first terminal end of the first wire and the first terminal end of the second wire, and a differential-mode signal is to be outputted from each of the second terminal end of the first wire and the second terminal end of the second wire.

6. A common-mode choke coil comprising:

a core configured to extend in a predetermined direction; and first and second wires intertwined and wound together around the core, wherein:

one segment of the intertwined and wound first and second wires and an adjacent segment of the intertwined and wound first and second wires are in contact with each other at at least three points, the at least three points include:

(i) contact point(s) between the first wire of one segment of the intertwined and wound first and second wires and the second wire of an adjacent segment of the intertwined and wound first and second wires; and (ii) contact point(s) between the second wire of the one segment of the intertwined and wound first and second wires and the first wire of the adjacent segment of the intertwined and wound first and second wires, (i) and (ii) are alternately and evenly spaced in a winding direction of the first and second wires in the common-mode choke coil, the core includes a first end side and a second end side opposite the first end side in the predetermined direction, and a first terminal end and a second terminal end of the first wire are on the first end side and the second end side of the core respectively with respect to the predetermined direction, and a first terminal end and a second terminal end of the second wire are on the first end side and the second end side of the core respectively with respect to the predetermined direction.

7. The common-mode choke coil according to claim 6, further comprising:

first and second external electrodes connected to the respective first terminal end and the second terminal end of the first wire, and third and fourth external electrodes connected to the respective first terminal end and the second terminal end of the second wire.

8. The common-mode choke coil according to claim 6, wherein the first terminal end and the second terminal end of the first wire and the first terminal end and the second terminal end of the second wire are not grounded.

9. The common-mode choke coil according to claim 6, wherein apart from the first wire and the second wire, the common-mode choke coil does not include a wire wound around the core.

10. The common-mode choke coil according to claim 6, wherein a differential-mode signal is to be inputted to each of the first terminal end of the first wire and the first terminal end of the second wire, and a differential-mode signal is to be outputted from each of the second terminal end of the first wire and the second terminal end of the second wire.

* * * * *